US009968949B2

(12) United States Patent
Keren

(10) Patent No.: US 9,968,949 B2
(45) Date of Patent: May 15, 2018

(54) PULSATING IRRIGATION DEVICE

(75) Inventor: Ron Keren, Kibbutz Hatzerim (IL)

(73) Assignee: Netafim, Ltd., Tel Aviv (IL)

( * ) Notice: Subject to any disclaimer, the term of this patent is extended or adjusted under 35 U.S.C. 154(b) by 255 days.

(21) Appl. No.: 13/592,007

(22) Filed: Aug. 22, 2012

(65) Prior Publication Data

US 2012/0312894 A1 Dec. 13, 2012

Related U.S. Application Data

(63) Continuation of application No. PCT/IL2011/000201, filed on Mar. 1, 2011.

(60) Provisional application No. 61/311,334, filed on Mar. 7, 2010.

(51) Int. Cl.

| | |
|---|---|
| ***B05B 1/08*** | (2006.01) |
| *B05B 12/06* | (2006.01) |
| *B05B 1/14* | (2006.01) |

(52) U.S. Cl.

CPC ..... *B05B 1/086* (2013.01); *B05B 1/14* (2013.01); *B05B 12/06* (2013.01)

(58) Field of Classification Search

CPC ..... B05B 12/06; B05B 8058/086; B05B 1/14; B05B 3/14; B05B 3/16; B05B 12/087; B05B 1/083

USPC ..... 137/417; 239/101

See application file for complete search history.

(56) References Cited

U.S. PATENT DOCUMENTS 971,982 A * 10/1910 Ford ..... F16K 17/0433 137/494
4,796,804 A * 1/1989 Weiss ..... B05B 1/3006 239/1
5,316,215 A * 5/1994 Mitchell ..... B05B 9/047 137/624.14
5,727,733 A 3/1998 Ruttenberg
2003/0221729 A1* 12/2003 Rosenberg ..... B05B 1/083 137/614.2
2004/0025965 A1* 2/2004 Mitchell ..... B05B 12/06 141/198
2006/0255176 A1* 11/2006 Yeiser ..... B05B 12/06 239/263.1

FOREIGN PATENT DOCUMENTS

| | | | | |
|---|---|---|---|---|
| FR | 1 321 217 | | 3/1963 | |
| GB | 2 334 071 | | 8/1999 | |
| GB | 2334071 | * | 8/1999 | ..... A01G 25/16 |
| IL | 92886 A | * | 7/1995 | ..... B05B 1/08 |

OTHER PUBLICATIONS

International Search Report in PCT/IL2011/000201, dated Jul. 7, 2011.
Written Opinion in PCT/IL2011/000201, dated Jul. 7, 2011.

* cited by examiner

*Primary Examiner* — Jason Boeckmann
*Assistant Examiner* — Joel Zhou
(74) *Attorney, Agent, or Firm* — Womble Bond Dickinson (US) LLP

(57) ABSTRACT

A pulsating irrigation device is provided that transforms a fluid flow entering the device to an intermittent pulsating fluid flow that is ejected from the device. The device has a chamber and at least one compressible member in pressure contact with the chamber. The compressible member compresses to assist the formation of the pulses ejected from the device and the fluid within the chamber is substantially sealed from contact with the interior of the compressible member.

18 Claims, 5 Drawing Sheets

PULSATING IRRIGATION DEVICE

RELATED APPLICATIONS

This is a Continuation of PCT/IL2011/000201, which was filed 1 Mar. 2011 and published as WO 2011/1110371A1 on 15 Sep. 2011, and which claims priority to U.S. Provisional Patent Application No. 61/311,334, filed 7 Mar. 2010. The contents of the above-identified applications are incorporated by reference in their entirety.

TECHNICAL FIELD

Embodiments of the present invention relate to pulsating irrigation devices and in particular to pulsating devices that transform an incoming fluid flow to an intermittent pulsating ejected fluid flow.

BACKGROUND

In such devices, the incoming fluid flow may be of relatively low flow and the ejected pulses may be transformed to be of a relatively high flow.

U.S. Pat. No. 5,727,733 describes a pulsating device with an elastic tube that can expand and contract on a barbed insert. Fluid entering the device fills a space between the elastic tube and the insert thereby increasing its volume until forming an opening between the tube and a barb of the insert that allows fluid to flow out from the space and onwards until it is finally ejected from the device as a fluid pulse.

SUMMARY

The following embodiment and aspects thereof are described and illustrated in conjunction with systems, tools and methods which are meant to be exemplary and illustrative, not limiting in scope.

In an embodiment of the present invention there is provided a pulsating device for transforming a fluid flow entering the device from a fluid source upstream to an intermittent pulsating fluid flow ejected from the device downstream, the device comprising a chamber for receiving the fluid flow entering the device from the fluid source and at least one compressible member in pressure contact with the chamber for assisting the formation of the pulsating fluid flow ejected from the device, wherein the fluid flow received within the chamber is substantially sealed from communication with an interior of the compressible member.

Optionally, the fluid entering the chamber increases the pressure within the chamber and the device further comprises a valve that is adapted to open above a first threshold pressure Po within the chamber to allow a fluid pulse to exit the chamber and after being opened to close below a second threshold pressure Pc within the chamber to terminate the fluid pulse exiting the chamber.

If desired, the compressible member is located within the chamber.

Optionally, the interior of the compressible member comprises a compressible material.

If desired, the compressible material is fluid.

Optionally, the fluid is gas or air.

Typically, the interior of the compressible fluid has a pressure Pg when no external pressure is applied thereupon, and wherein $Pg<Po$ and optionally $Pg<Pc$.

Further typically, the first threshold pressure Po is larger than the second threshold pressure Pc.

Optionally, the fluid has a pressure Ps at the fluid source and the device comprises a flow control means via which the fluid entering the chamber from the fluid source passes, the flow control means forming a pressure drop Pd to the fluid entering the chamber, wherein $Ps-Po \geq Pd$.

If desired, the fluid entering the chamber has a flow rate Fin and the flow rate of fluid exiting the chamber just before the second threshold pressure Pc in the chamber is reached and the valve closes is Ft, wherein $Fin<Ft$.

In addition to the exemplary aspects and embodiment described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
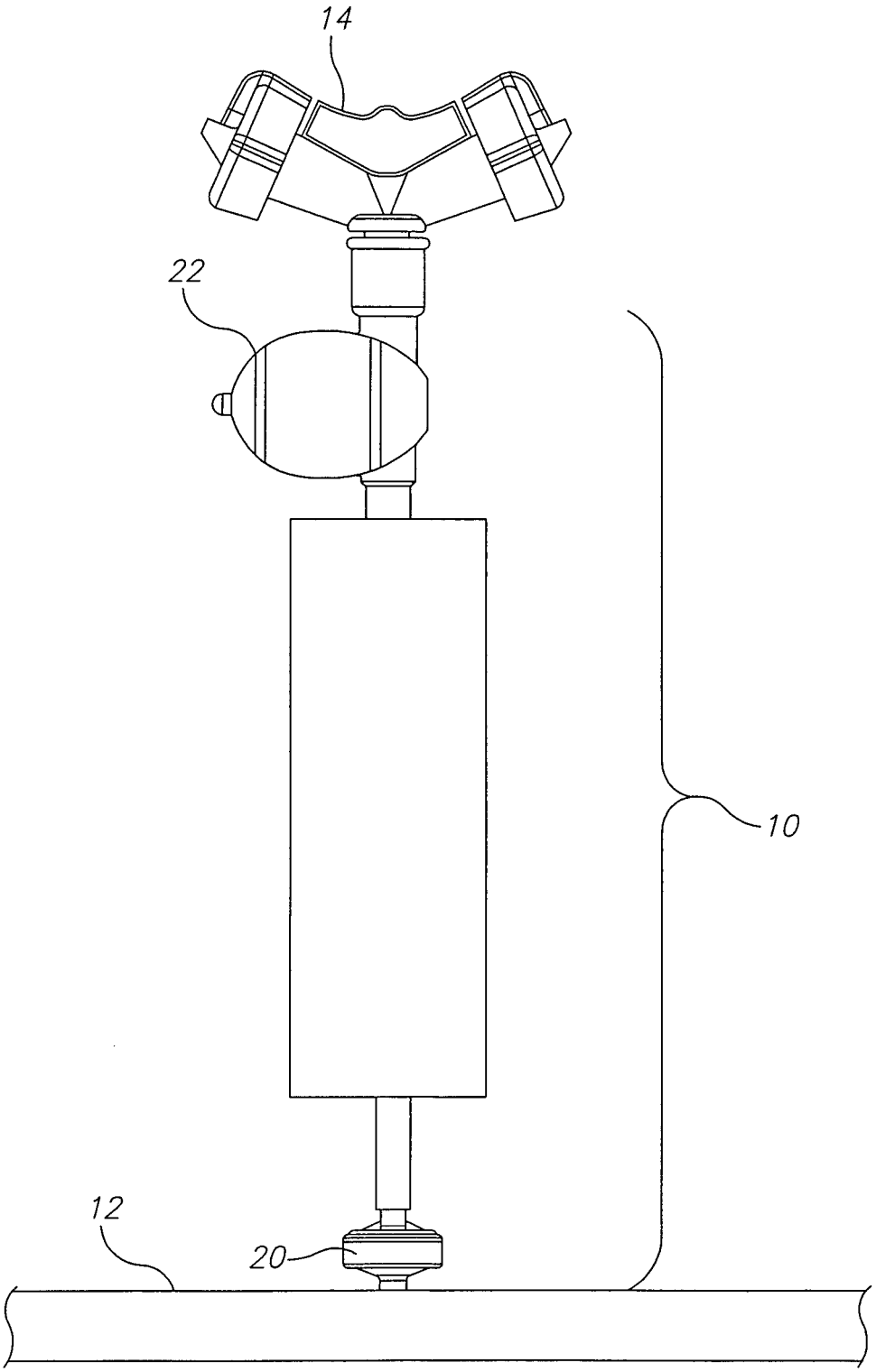
FIG. 1 schematically shows a side view of a pulsating device in accordance with an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1. A pulsating device 10 in accordance with embodiments of the present invention is adapted to transform an incoming fluid flow from a fluid source 12 upstream to an outgoing fluid pulse that is ejected downstream. The fluid may be a liquid such as water that may contain substances used in agricultural applications in which the device may be utilized such as plant nutrients, pesticides and/or medications; and the fluid source upstream may optionally be a pipe such as an irrigation pipe and the ejected fluid pulse flowing downstream may optionally be emitted to the outside environment by an emitter 14.

It is noted that the ejected fluid flow exiting the device may in some embodiments be of a non-regulated nature, and in other embodiments may be of a regulated nature that exhibits a substantially constant emitted fluid flow or pulse for a given pressure range for which it is designed to operate. This non-regulated or regulated nature may be defined for example by the emitter 14 being used if it is respectively of the non-regulated type or of the regulated type. In addition, the device 10 in accordance with various embodiments may be used in agricultural and non-agricultural applications such as irrigation, frost protection, cooling in dwellings such as greenhouses (etc.). It should be noted that directional terms appearing throughout the specification and claims, e.g. "upstream", "downstream" etc., (and derivatives thereof) are for illustrative purposes only, and are not intended to limit the scope of the appended claims.

Figure 2:
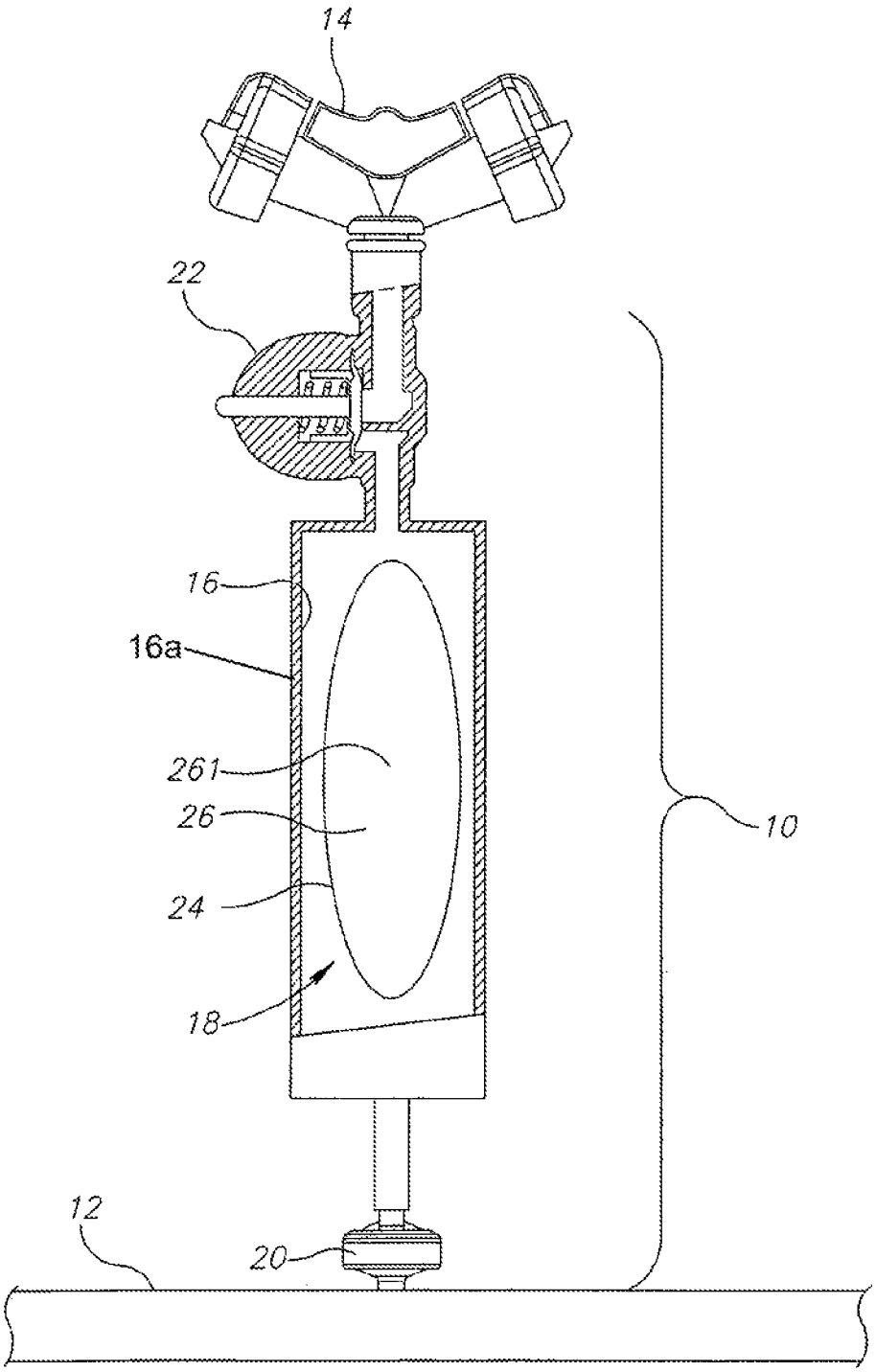
FIGS. 2 to 5 schematically show partial cross sectional views of the pulsating device of FIG. 1 at various stages of its pulsating operation.

Attention is additionally drawn to FIG. 2. In an embodiment, the pulsating device 10 has a chamber 16 having a chamber wall 16*a*, at least one compressible member 18 located optionally in the chamber 16, a flow control means 20 located upstream of the chamber, and a valve 22 located downstream of the chamber 16. The compressible member 18 has an optional outer boundary 24 that optionally encapsulates an interior 26 thereof which in an initial non-compressed state of the compressible member 18 has an initial volume 261. Upon commencement and then rise of external pressure within the chamber 16 that is applied thereupon, the compressible member 18 is adapted to be squeezed to have a reduced interior volume that is smaller than the initial volume 261 and upon the reduction of such external pressure the compressible member 18 is adapted to expand back towards its initial volume 261.

The valve 22 may be adapted to open and allow fluid to flow downstream out of the chamber 16 above a first threshold pressure Po in the chamber 16 and after being opened may shut off to close the path out of the chamber 16 as the pressure within the chamber 16 drops to a level below a second threshold fluid pressure Pc which is smaller than the first threshold pressure Po.

Figure 3:
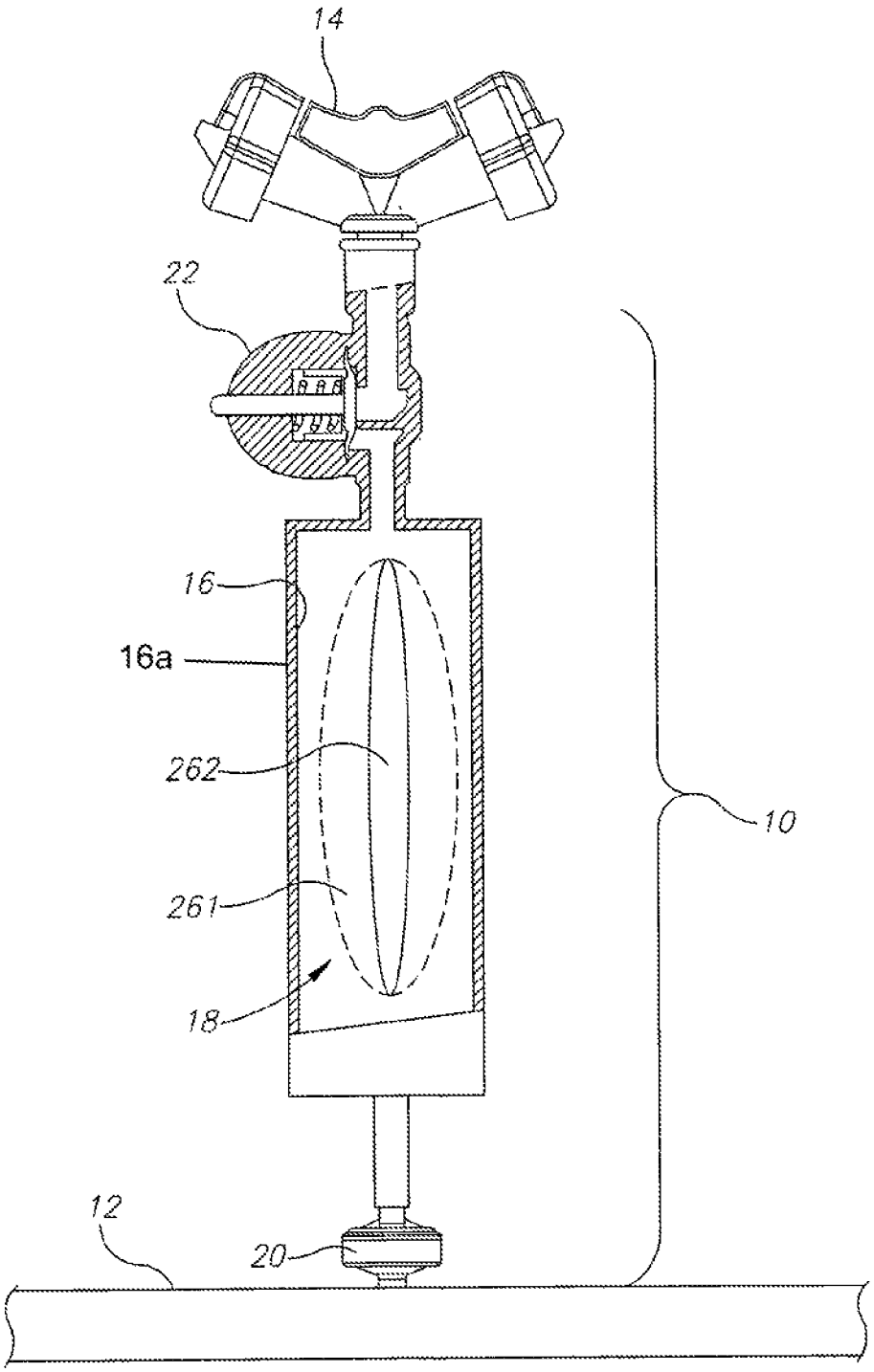

Attention is additionally drawn to FIG. 3. In an embodiment, fluid having a pressure Ps at the fluid source 12 that enters the device 10 flows through the flow control means 20 where it is urged to pass via a limited passage that reduces the flow rate of fluid entering the chamber 16 to a relatively low incoming fluid rate Fin. The fluid entering the device is received within the chamber 16 between the compressible member's outer boundary 24 and the chamber wall 16*a*. The chamber 16 receiving the fluid from the fluid source 12 may in some cases include air such as when first starting to use the device 10 or may be substantially full of fluid such as fluid that it optionally already received from the fluid source 12. Such air that may be present in the chamber 16 may exit the chamber 16 for example via the emitter 14 during use of the device 10 or may remain at least partially trapped within the chamber 16. The fluid being received in the chamber 16 increases the pressure in the chamber 16 and occupies at least a part of the volume initially occupied by the compressible member 18 by squeezing the compressible member 18 away from its initial volume 261 which is outlined in FIG. 3 by a dashed line towards a squeezed terminal state where it has a reduced terminal volume 262. The reduced terminal volume 262 is outlined in FIG. 3 by a continuous line and is associated with a rise of pressure within the chamber 16 to the first threshold pressure Po.

The fluid passing through the limited passage in the flow control means 20 exhibits a pressure drop Pd; and Ps, Pd and Po should satisfy a relationship of $Ps-Po \geq Pd$ for the valve 22 to be able to open and allow fluid out of the chamber 16. Optionally, the flow control means 20 is of a regulating type such as a regulating drip emitter that is adapted to regulate the flow rate of fluid entering the chamber 16 to a nominal substantially constant incoming fluid rate Fin that is substantially independent of inlet pressure Ps at the fluid source 12 for a given pressure range for which it is designed to operate. The pressure range Pmin to Pmax defines the given range for which the regulating flow control means 20 is designed to regulate; and Pmin, Pmax and Pd should satisfy the relation of $Pmax \geq Pd \geq Pmin$ for the incoming fluid rate Fin to be regulated.

Figure 4:
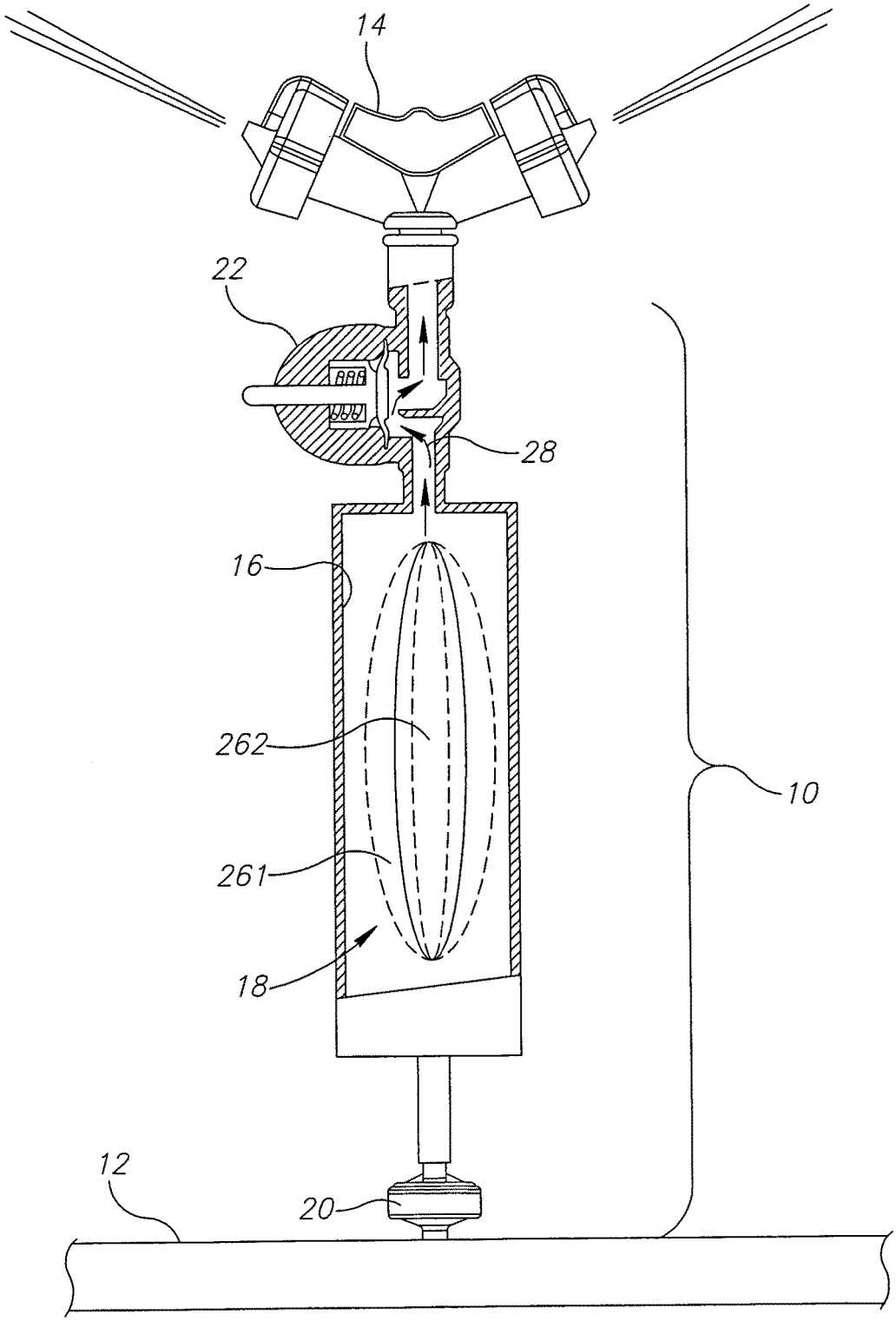

Attention is additionally drawn to FIG. 4. As the pressure within the chamber 16 rises and reaches the first threshold pressure Po, the valve 22 opens and a path is formed via which a given fluid pulse indicated in FIG. 4 by arrows 28 may start to form. The pulse flows downstream out of the chamber 16 optionally to the emitter 14 where it may be ejected out to the external environment. As the pulse exits the chamber 16, the pressure within the chamber 16 drops and the compressible member 18 expands back towards its initial volume 261 to assist the formation of the pulse being ejected out of the device 10 by recapturing a partial-volume in the chamber 16 that was previously occupied by fluid thereby urging an amount of fluid in the chamber 16 substantially equal to said partial-volume out of the chamber 16. Both the initial and terminal volumes 261, 262 of the compressible member 18 are outlined in FIG. 4 by dashed lines while the compressible member 18 on its expansion from the terminal volume 262 towards the initial volume 261 is outlined in FIG. 4 by a continuous line.

Figure 5:
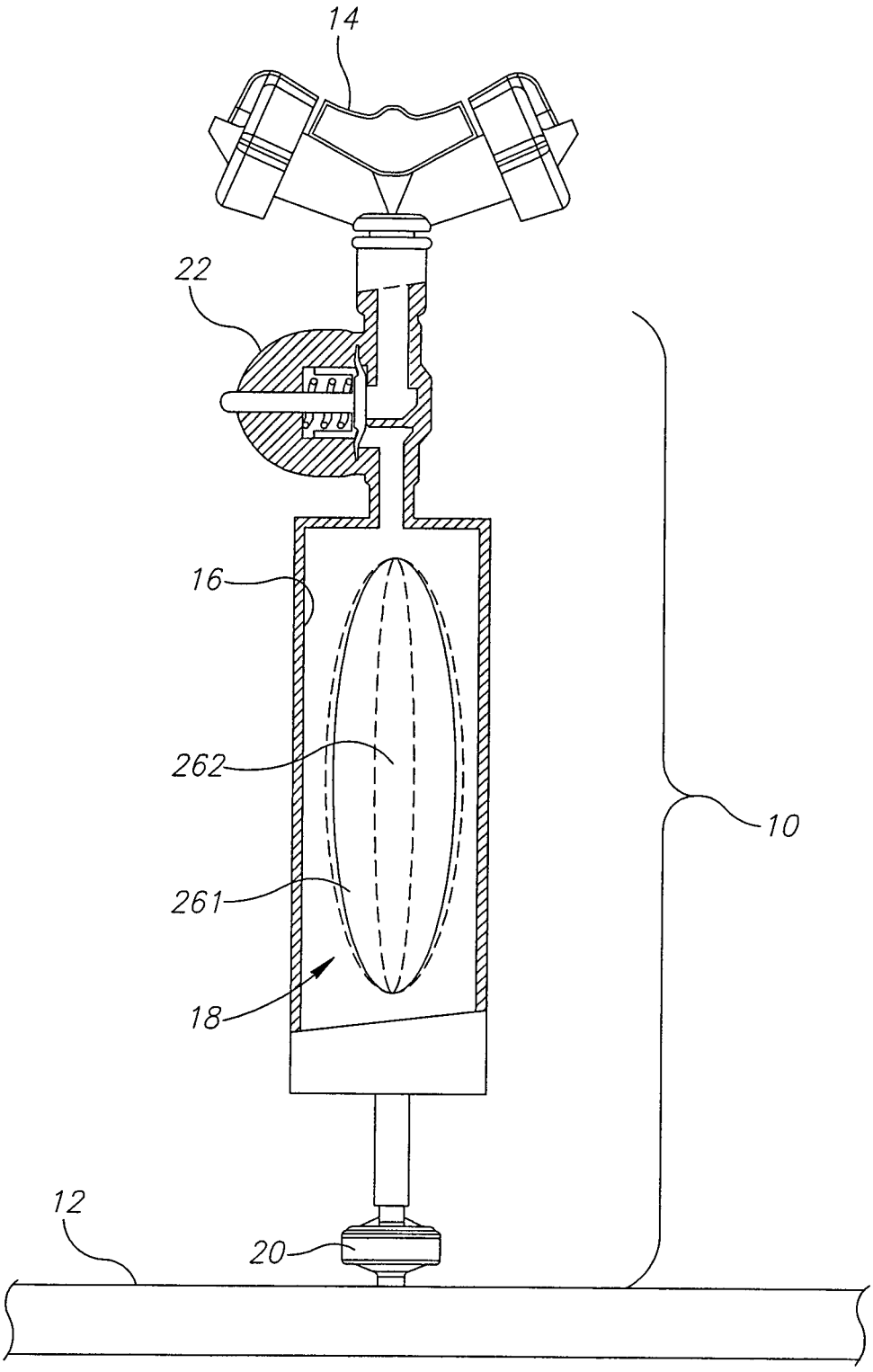

Attention is additionally drawn to FIG. 5. As the level of pressure within the chamber 16 decreases towards the second threshold pressure Pc, the flow rate of fluid exiting the chamber 16 may decrease too if being of the non-regulated nature towards a terminal fluid rate Ft that is present just before the pressure in the chamber 16 reaches the second threshold pressure Pc and the valve 22 closes to terminate the given fluid pulse being ejected out of the device 10. The flow rate of fluid exiting the chamber 16 if being of the regulated nature may be substantially equal to Ft for a given pressure range for which it is designed to be regulated. The closing valve 22 stops the expansion of the compressible member 18 at an inflated volume that optionally may be similar to or smaller than the initial volume 261. The ongoing incoming fluid rate Fin entering the chamber 16 at the flow control means 20 resumes to increase the pressure in the chamber 16 which leads to the formation of a consecutive fluid pulse that is ejected from the device 10. The initial and terminal volumes 261, 262 of the compressible member 18 are outlined in FIG. 5 by dashed lines and the inflated volume of the compressible member 18 is outlined in FIG. 5 by a continuous line. In an embodiment, the terminal fluid rate Ft and the incoming fluid rate Fin satisfy a relationship of $Fin < Ft$ for the valve 22 to be able to close the exit of fluid out of the chamber 16 as the pressure in the chamber 16 drops to the second threshold pressure Pc.

In an embodiment, the interior 26 of the compressible member 18 may consist of various types of compressible materials such as gas or air and the outer boundary 24 of the compressible member 18 may be substantially impervious so as to substantially seal the interior 26 of the compressible member 18 from contact with fluid in the chamber 16. In the optional case where the compressible material is any fluid such as gas or air, such fluid has a pressure Pg that is measured when no external pressure is applied thereupon. In embodiments of the present invention, Pg satisfies a relationship of $Pg < Po$ so that the compressible member 18 may exhibit compression during use of the device 10, and preferably Pg satisfies a relationship of $0 \leq Pg \leq Pc$ so that the compressible member 18 may immediately start to compress as pressure in the chamber rises to above the second threshold pressure Pc.

The outer boundary 24 of the compressible member 18 may optionally be formed from materials that increase the barrier properties of the outer boundary 24 such as polymers like Polyvinylidene Chloride or copolymers like EVOH or metalized laminate films like the Metalized laminate polyester film manufactured by Shanghai Radix Vacuum Metallising Co. Ltd. or the VIP laminate film manufactured by Hanita Coatings RCA Ltd.

By way of a non binding example, a pulsating device 10 in accordance with an embodiment of the present invention may communicate with a fluid source upstream having a pressure Ps of 2.5 to 5 bars, the valve 22 may have a first threshold pressures Po of 2 bars and a second threshold pressure Pc of 1 bar, the flow control means 20 when being of the regulated type may create a pressure drop of between 0.5 to 4 bars at the fluid passing therethrough and the incoming fluid rate Fin formed by such a regulated flow control means 20 may be 12 L/h and the fluid rate exiting the chamber 16 just before the valve 22 closes may have terminal fluid rate Ft of 20 L/h.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Although the present embodiment has been described to a certain degree of particularity, it should be understood that various alterations and modifications could be made without departing from the scope of the invention as hereinafter claimed.

What is claimed is:

1. A pulsating irrigation device for transforming a fluid flow entering the device from a fluid source upstream to an intermittent pulsating fluid flow ejected from the device downstream via a device outlet, the device comprising:

a chamber having a chamber wall, a chamber inlet and a chamber outlet distinct from the chamber inlet, the chamber for receiving, via the chamber inlet, the fluid flow entering the device from the fluid source; and at least one compressible member in pressure contact with the chamber for assisting the formation of the pulsating fluid flow ejected from the device, the at least one compressible member having an outer boundary and an interior, wherein the fluid flow is received within the chamber between the compressible member's outer boundary and the chamber wall, and is substantially sealed from communication with the interior of the compressible member, and the device further comprises a valve located downstream of the chamber that is adapted to open when pressure is above a first threshold pressure Po within the chamber to allow a fluid pulse to exit the chamber via the chamber outlet, and after being opened, the valve is adapted to close below a second threshold pressure Pc within the chamber, to terminate the fluid pulse exiting the chamber;

wherein:

the valve is separated from, and not in contact with, the compressible member;

the first threshold pressure Po is larger than the second threshold pressure Pc;

when the pressure within the chamber reaches Po, the fluid itself causes the valve to open; and the fluid has a pressure Ps at the fluid source and the device comprises a flow control means via which the fluid entering the chamber from the fluid source passes, the flow control means forming a pressure drop Pd to the fluid entering the chamber, wherein $Ps-Po \geq Pd$.

2. The pulsating irrigation device according to claim 1, wherein the compressible member is located within the chamber.

3. The pulsating irrigation device according to claim 2, wherein the interior of the compressible member comprises a compressible material.

4. The pulsating irrigation device according to claim 3, wherein the compressible material is fluid.

5. The pulsating irrigation device according to claim 4, wherein the fluid is gas or air.

6. The pulsating irrigation device according claim 3, wherein the interior of the compressible material has a pressure Pg when no external pressure is applied thereupon, and wherein $Pg<Po$.

7. The pulsating irrigation device according to claim 6, wherein $Pg<Pc$.

8. The pulsating irrigation device according to claim 1, wherein the fluid entering the chamber has a flow rate Fin and the flow rate of fluid exiting the chamber just before the second threshold pressure Pc in the chamber is reached and the valve closes is Ft, wherein $Fin<Ft$.

9. A pulsating irrigation device for transforming a fluid flow entering the device from a fluid source upstream to an intermittent pulsating fluid flow ejected from the device downstream, the device comprising:

a regulating drip emitter configured to receive fluid from a fluid source and reduce a flow rate of the fluid to a substantially constant fluid flow rate that is independent of pressure from the fluid source;

a chamber having a chamber wall, a chamber inlet and a chamber outlet distinct from the chamber inlet, the chamber in fluid communication with the fluid source and configured to receive fluid therefrom, via the chamber inlet, at said substantially constant fluid flow rate;

at least one compressible member in pressure contact with the chamber for assisting the formation of the pulsating fluid flow ejected from the device, the at least one compressible member having an outer boundary and an interior, wherein the fluid is received within the chamber between the compressible member's outer boundary and the chamber wall, and is substantially sealed from communication with the interior of the compressible member; and a valve downstream of the chamber and in fluid communication therewith via the chamber outlet; wherein:

the valve is separated from, and not in contact with, the compressible member;

the valve is configured to open and allow the fluid to pass therethrough when pressure within the chamber reaches a first threshold pressure Po;

the valve configured to close, after being opened, when a pressure within the chamber drops to a second threshold pressure of Pc, with $Pc<Po$, thereby cutting off additional fluid from passing therethrough and forming a fluid pulse; and when the pressure within the chamber reaches Po, the fluid itself causes the valve to open.

10. The pulsating irrigation device according to claim 9, wherein:

the valve is configured to repeatedly open and close while fluid continues to enter the chamber, thereby creating intermittent fluid pulses.

11. The pulsating irrigation device according to claim 10, wherein the compressible member is located within the chamber.

12. The pulsating irrigation device according to claim 11, wherein:

the interior of the compressible member comprises a fluid having a pressure Pg when no external pressure is applied thereupon, and $Pg<Pc$.

13. An irrigation system comprising:

an irrigation pipe serving as a fluid source; and one or more pulsating irrigation devices in accordance with claim 9 connected to the irrigation pipe.

14. The irrigation system according to claim 13, wherein:

fluid in the irrigation pipe has a pressure Ps;

the regulating drip emitter causes a pressure drop of Pd; and $Ps-Po \geq Pd$.

15. The irrigation system according to claim 13, wherein:

fluid entering the chamber has a flow rate Fin;

the flow rate of fluid exiting the chamber just before the second threshold pressure Pc in the chamber is reached and the valve closes is Ft; and $Fin < Ft$.

16. The irrigation system according to claim 13, further comprising an emitter connected downstream of the valve and configured to intermittently eject fluid to an external environment.

17. The pulsating irrigation device according to claim 9, wherein:

the at least one compressible member is located inside the chamber; and the valve is located outside the chamber.

18. The pulsating irrigation device according to claim 1, wherein:

the at least one compressible member is located inside the chamber; and the valve is located outside the chamber.

* * * * *